US005161708A

United States Patent [19]

An

[11] Patent Number: 5,161,708

[45] Date of Patent: Nov. 10, 1992

[54] CATHODE RAY TUBE

[75] Inventor: Min-ho An, Kwacheon, Rep. of Korea

[73] Assignee: Samsung Electron Devices Co., Ltd., Kyunggi-do, Rep. of Korea

[21] Appl. No.: 880,005

[22] Filed: May 8, 1992

[30] Foreign Application Priority Data

Jul. 10, 1991 [KR] Rep. of Korea ..... 91-10561

[51] Int. Cl.[5] ..... H01J 29/86

[52] U.S. Cl. ..... 220/2.1 A; 313/477 R; 313/461; 358/242

[58] Field of Search ..... 220/2.1 A, 2.1 R, 2.3 R, 220/2.3 A; 313/477 R, 461; 358/242, 243, 246, 250, 251, 252, 253, 217

[56] References Cited

U.S. PATENT DOCUMENTS

| | | | |
|---|---|---|---|
| 4,591,757 | 5/1986 | Bakker et al. | 220/2.1 A |
| 4,621,296 | 11/1986 | Lee | 220/2.1 A |
| 4,777,401 | 10/1988 | Hosokoshi et al. | 313/461 |
| 4,839,556 | 6/1989 | Ragland, Jr. | 313/477 R |
| 4,985,658 | 1/1991 | Canevazzi | 220/2.1 A |
| 5,107,999 | 4/1992 | Canevazzi | 220/2.1 A |

*Primary Examiner*—Joseph Man-Fu Moy
*Attorney, Agent, or Firm*—Leydig, Voit & Mayer

[57] ABSTRACT

In a cathode ray tube panel, contour lines of uniform thickness are continuous, closed loops without discontinuities at the periphery of the screen providing a natural picture throughout the panel. Hence, a distorted picture rarely occurs at the periphery of the panel.

8 Claims, 2 Drawing Sheets

CATHODE RAY TUBE

BACKGROUND OF THE INVENTION

The present invention relates to a cathode ray tube, and more particularly to an improvement in the panel of a cathode ray tube.

Generally, a cathode ray tube has such elements as a neck, a funnel, and a panel. In such a cathode ray tube, an assembled electron gun is installed in a predetermined position in the neck, and a phosphor screen is formed on the inner surface of the panel. A shadow mask is installed inside the cathode ray tube and spaced apart from the phosphor screen at a predetermined distance. In a cathode ray tube constructed as above, the inside pressure of the tube is at a high vacuum, approximately $10^{-6}$ to $10^{-7}$mmHg, so as to easily emit an electron beam and allow it to proceed away from the electron gun.

By forming the tube in a high vacuum state, the exterior of the tube is under great atmospheric pressure. Accordingly, as illustrated in FIG. 1, due to the structural characteristic of the circumference of the tube, a location 1*b* on the funnel as well as a location la on the panel are subjected to compressive stress. A periphery location 1*c* on the funnel and panel is subjected to tensile stress, which weakens the structural aspects of location 1*c*. Therefore, when a highly evacuated cathode ray tube implodes, there is dangerous flying glass at its periphery. Hence, a safe tube should be manufactured by reinforcing the structurally weak portions. For this purpose, a tension band is conventionally employed to reinforce the periphery of the funnel and panel. Also, the periphery of the panel is made to be relatively thicker than the center of the panel.

However, since the panel of a cathode ray tube is substantially rectangular in shape and due to the structural characteristics of a cathode ray tube, the deforming force caused by atmospheric pressure becomes greatest along the edges of the shorter axis of the panel, the least along its diagonal, and the mean along its longer axis. Based upon consideration of the above-described matters, the panel is formed to vary in thickness. That is, the panel is the thinnest along the diagonal line of the panel, and is the thickest along the edges of the shorter axis.

Therefore, contour lines 2 drawn along the same thickness, as illustrated in FIG. 2, of a panel 1 constructed as above, have discontinuous points at periphery 3 of a screen. As a result, a problem occurs wherein the picture is distorted at the screen's periphery due to the discontinuity of contour lines 2 at periphery 3.

SUMMARY OF THE INVENTION

The present invention provides a cathode ray tube, wherein the above-described problem is solved.

Accordingly, it is the object of the present invention to provide a cathode ray tube employing a panel whose structure is improved to decrease distortion of a picture at the periphery of the panel.

To achieve the above and other objects of the present invention, there is provided a cathode ray tube comprising a phosphor screen on the inner surface of a curved rectangular panel whose central axis is perpendicular to the center of the phosphor screen, substantially having a predetermined ratio between the longer and shorter lengths, provided that, when a plane in contact with the center of the panel is defined as a tangent plane, the longer axis of the panel which extends in the horizontal direction of the tangent plane is designated as the X-axis, the shorter axis which extends in the vertical direction is designated as the Y-axis, an axis perpendicular to the tangent plane passing through the center of the panel is designated as the Z-axis, and arbitrary points on each of the X-axis and Y-axis are designated as arbitrary points a and b having the same ratio as the predetermined ratio between the longer and shorter lengths of the panel, wherein the thickness of the panel along a line through the arbitrary point a of the X-axis drawn perpendicular to the tangent plane is the same as the thickness of the panel along a line through the arbitrary point b of the Y-axis drawn perpendicular to the tangent plane, and contour lines are positioned within a triangular region formed by a straight line of X coordinates at X=a, a straight line of Y coordinates at Y=b, and a line connecting the arbitrary points a and b, or placed on a line obtained by connecting the straight line of X coordinates at X=a and the straight line of Y coordinates at Y=b, or the straight line which connects the arbitrary points a and b, thereby eliminating discontinuous points of the contour lines throughout a screen.

According to the present invention, the contour lines of the panel's thickness form closed loops throughout the screen of the panel. Therefore, a distorted picture rarely occurs at the periphery of the screen.

Preferably, the interval between adjacent contour lines is uniform throughout the whole region of the picture, thereby providing a natural picture throughout the screen.

By improving the shape of the contour lines of the panel's thickness, the present invention provides a cathode ray tube wherein a picture is rarely distorted. As a result, the present invention enhances the value of the end product.

BRIEF DESCRIPTION OF THE DRAWINGS

These and other objects, features, aspects and advantages of the present invention will become more apparent when taken in conjunction with the accompanying drawings, in which.

DETAILED DESCRIPTION OF THE INVENTION

Figure 1:
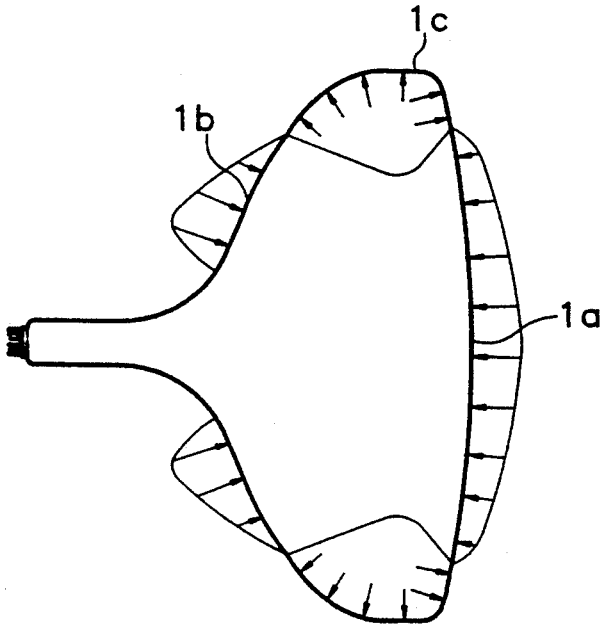
FIG.1(PRIOR ART)
FIG. 1 is a schematic view showing the atmospheric pressure applied to the circumference of a conventional cathode ray tube.
Figure 2:
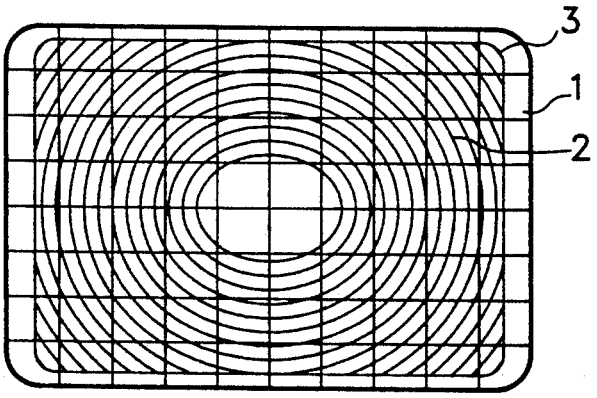
FIG.2(PRIOR ART)
FIG. 2 is a schematic view of the panel of the conventional cathode ray tube, in which contour lines are illustrated.
Figure 3:
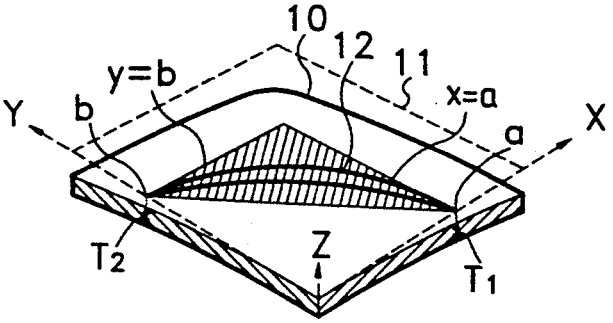
FIG. 3 is a sectioned view used for illustrating the panel of a cathode ray tube according to the present invention.
Figure 4:
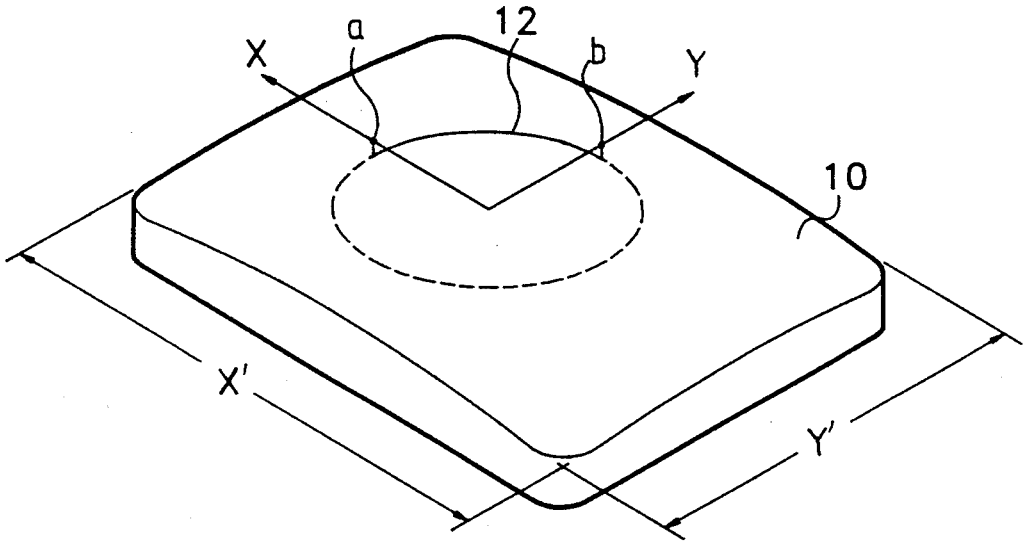
FIG. 4 is a schematic view for illustrating the panel of the cathode ray tube according to the present invention.

FIG. 3 shows an extracted quadrant of a panel 10 according to the present invention, and FIG. 4 shows the entire surface of panel 10. Panel 10 of a cathode ray tube according to the present invention is formed to have a predetermined curvature and a predetermined ratio between long and short sides, e.g., the ratio between the length of the long side and the length of the short side is 4:3.

To begin with, a plane in contact with the center of panel 10 is a tangent plane 11. With respect to panel 10, the longer axis of tangent plane 11 is designated as the X-axis, its shorter axis is designated as the Y-axis, and the perpendicular axis passing through center of the panel and perpendicular to the tangent plane is the Z-axis. Also, arbitrary points a and b of the X and Y axes, respectively, are located at points having the same relative ratio as the sides of panel 10. In other words, arbitrary points a and b are designated on the X-Y axis by the relationship that $X':Y'=a:b$, where $X'$ is the length of the panel's longer side and $Y'$ is the short side's length.

As shown in FIG. 3, in the present invention, a thickness $T_1$ of panel 10 at an arbitrary point a on the X-axis along a line drawn perpendicular to tangent plane 11 is the same as a thickness $T_2$ of the panel at an arbitrary point b on the Y-axis along a line drawn perpendicular to the tangent plane 11. Further, a contour line 12 drawn through both points is located within a portion (marked by oblique lines) defined by a triangle formed by a straight line of X coordinates at $X=a$, a straight line of Y coordinates at $Y=b$, and a line connecting points a and b. Here, contour line 12 can also be placed on a line connecting arbitrary points a and b, or on a line obtained by connecting the straight line of X coordinates at $X=a$ and the straight line of Y coordinates at $Y=b$.

Figure 5:
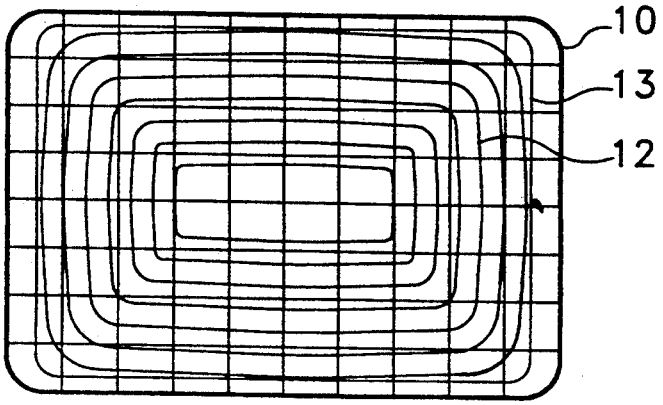
FIG. 5 is a schematic view of the panel of the cathode ray tube according to the present invention, in which contour lines are shown.

FIG. 4 illustrates the continuation of contour line 12 drawn by carrying out the foregoing method throughout all four quadrants of the panel. FIG. 5 shows multiple contour lines 12 throughout the panel, having predetermined intervals between each contour line.

As illustrated in FIG. 5, in the cathode ray tube according to the present invention, contour lines 12 of panel 10 are drawn as closed loops without discontinuous points at the periphery of a picture 13 of panel 10. Therefore, while a picture is distorted at the periphery of a screen of a conventional panel due to the discontinuous contour lines, such distortion rarely occurs in the cathode ray tube according to the present invention. Further, the present invention provides a cathode ray tube which can realize a natural picture throughout the screen by maintaining a constant interval between contour lines.

What is claimed is:

1. A cathode ray tube comprising a phosphor screen on the inner surface of a curved rectangular panel whose central axis is perpendicular to the center of said phosphor screen, substantially having a predetermined ratio between the longer and shorter lengths, provided that, when a plane in contact with the center of said panel is defined as a tangent plane, the longer axis of said panel which extends in the horizontal direction of said tangent plane is designated as the X-axis, the shorter axis which extends in the vertical direction is designated as the Y-axis, the axis perpendicular to said tangent plane and passing through the center of said panel is designated as the Z-axis, and an arbitrary point on each of said X-axis and Y-axis are designated as arbitrary points a and b having the same ratio as said predetermined ratio between the longer and shorter lengths of said panel, wherein the thickness of said panel along a line through said arbitrary point a of said X-axis drawn perpendicular to said tangent plane is the same as that of said panel along a line through said arbitrary point b of said Y-axis drawn perpendicular to said tangent plane, and contour lines are positioned within a triangular region formed by a straight line of X coordinates at $X=a$, a straight line of Y coordinates at $Y=b$, and a line connecting said points a and b, or are placed on a line obtained by connecting said straight line of X coordinates at $X=a$ and said straight line of Y coordinates at $Y=b$, or a straight line connecting said points a and b, thereby eliminating discontinuous points of said contour lines throughout a screen.

2. A cathode ray tube as claimed in claim 1, wherein said contour lines of said panel are spaced apart from each other at predetermined intervals.

3. A panel for a cathode ray tube comprising:

a panel having a curved rectangular outer surface and a central axis orthogonal to said outer surface, a curved rectangular inner surface, and a thickness between said outer and inner surfaces measured along a direction parallel to the central axis, each of said outer and inner surfaces having a longer side and a shorter side in a predetermined ratio, the longer side being designated as the X-axis and the shorter side being designated as the Y-axis, wherein at each arbitrary point a on the X-axis and each arbitrary point b on the Y-axis chosen in the predetermined ratio the thickness at the arbitrary point a is the same as the thickness at the arbitrary point b and contour lines of uniform thickness connecting points a and b lie within a triangle defined by a line $X=a$, a line $Y=b$ and a straight line connecting the points a and b.

4. The panel of claim 3 wherein the contour lines of the panel are continuous closed lines lying within the sides of the panel whereby picture distortion of the panel in a cathode ray tube is minimized.

5. The panel of claim 3 wherein the predetermined ratio is 4:3.

6. A cathode ray tube comprising:

a curved rectangular panel having an orthogonal central axis, a thickness measured parallel to the central axis, and a longer side and a shorter side in a predetermined ratio, the longer side extending along an X-axis direction and the shorter side extending along a Y-axis direction wherein at an arbitrary point a on the X-axis and an arbitrary point b on the Y-axis having a ratio equal to the predetermined ratio the thickness of panel at the point a is equal to the thickness of the panel at the point b and contour lines of uniform thickness connecting points a and b lie within a triangle defined by a line $X=a$, a line $Y=b$ and a straight line connecting the points a and b.

7. The cathode ray tube of claim 6 wherein the contour lines of the panel are continuous closed lines lying within the sides of the panel whereby picture distortion in the cathode ray tube is minimized.

8. The cathode ray tube of claim 6 wherein the predetermined ratio of the longer side to the shorter side is 4:3.

* * * * *